United States Patent [19]

Bartram et al.

[11] 4,018,073

[45] Apr. 19, 1977

[54] APPARATUS FOR SHAPING WIRE AND RIBBON STRUCTURES OBTAINED BY SLITTING METALLIC COIL STOCK

[75] Inventors: Ronald D. Bartram, Raleigh, N.C.; Charles J. Runkle, Guntersville, Ala.

[73] Assignee: Monsanto Company, St. Louis, Mo.

[22] Filed: May 3, 1976

[21] Appl. No.: 682,412

[52] U.S. Cl. ..... 72/199; 72/203

[51] Int. Cl.[2] ..... B21B 27/00; B21B 15/00

[58] Field of Search ..... 72/203, 222, 245, 221, 72/199

[56] References Cited

UNITED STATES PATENTS

| | | | |
|---|---|---|---|
| 159,978 | 2/1875 | Swift et al. | 72/221 |
| 3,315,511 | 4/1967 | Turner | 72/221 |

*Primary Examiner*—Milton S. Mehr

*Attorney, Agent, or Firm*—Russell E. Weinkauf

[57] ABSTRACT

An apparatus is disclosed for shaping the cross-section of a metal wire or metal ribbon product obtained by slitting metallic coil stock into multiple lengths of wire with an aspect ratio of 1 or ribbon having an aspect ratio of 2 or more. The product obtained from the slitting procedure is marred by the presence of a burr which impairs mechanical properties and consequently must be eliminated. In previous practice, this was achieved by feeding the slit product through the nip of a pair of mating, shaping rolls having a fixed engagement. However, problems arise from run to run when the rolls are in fixed engagement. For example, variations in the thickness of the material being processed presents difficulties with a fixed engagement.

In the disclosed apparatus engagement is allowed to vary while the engagement force is held constant. In brief, this is accomplished by mounting the shaping rolls on separate support members with one of the support members being movable to permit the roll engagement to vary. A constant engagement force is maintained by the provision of a means for applying a constant downward force on the movable roll support member.

4 Claims, 4 Drawing Figures

APPARATUS FOR SHAPING WIRE AND RIBBON STRUCTURES OBTAINED BY SLITTING METALLIC COIL STOCK

FIELD OF THE INVENTION

This invention relates generally to apparatus for shaping continuous lengths of metal wire or ribbon. More particularly, the invention is directed to an improved apparatus for shaping metal wire and ribbon obtained by slitting light gauge coil stock in order to eliminate the burrs which have been formed as a result of the slitting operation.

BACKGROUND OF THE INVENTION

In U.S. Pat. 3,939,745 to Weeks, et. al. an apparatus is disclosed for accomplishing a precision slitting of light gauge coil stock to form multiple continuous lengths of metal wire or ribbon. The slit products obtained are characterized by a cross-sectional area of less than $7.0 \times 10^{-4}$ square inch and an aspect ratio of less than 5 with aspect ratio being defined as the ratio between width and thickness. Those products having a square cross-section (i.e., an aspect ratio of one) are generally referred to in the art as "wire", while products which have an aspect ratio of greater than one are commonly referred to as "ribbon".

Although the capability for producing metal wire and ribbon of the aforementioned dimensions by slitting procedures offers a significant economic advantage over other methods of production, an inherent problem which must be overcome is the formation of an undesirable burr on the cross-section of the slit product. For example, when a 10 mil wide steel wire is formed by slitting a 10 mil thick steel strip, the resulting product has a slightly distorted square shaped cross-section due to the presence of burrs along its length. These burrs are formed when adjacent lengths of wire are separated in the slitting operation. Since the burr provides a prominent crack initiation site, it obviously has an adverse effect on the mechanical properties of the slit product. The resulting loss in fatigue resistance is especially harmful in the case of steel products intended for use as reinforcing elements in pneumatic tires.

An apparatus for eliminating the aforementioned burr formation is disclosed in commonly assigned U.S. patent application Ser. No. 623,289 filed Oct. 17, 1975. The apparatus consists of a pair of revolving shaping rolls. One roll is provided with a continuous annular groove having a curved bottom portion. The second roll contains a continuous annular land adapted to engage the groove of the opposing roll so as to force the slit product which is delivered between the rolls into the groove and thereby effect a shaping of the product to eliminate the burr. When in operation, the rolls are in a mechanically fixed engagement. That is, during set up the rolls are engaged until a satisfactory wire cross-section is obtained after which they are locked into place.

Although this apparatus has been successful in the elimination of burr formations, a consistent problem has been an inability to establish and maintain equivalent roller engagement settings from one run to another. The fact that roller engagement will vary from run to run necessitates costly precision during roller manufacture and extra time during set-up. However, even close control of roller diameter and groove depth does not eliminate the engagement variation resulting from variations in the thickness of the slit product being processed.

It is, therefore, an object of this invention to provide an improved roll shaping apparatus for eliminating the burr from slit metal products.

It is a further object of this invention to provide an improved roll shaping apparatus for eliminating the burr from slit metal products wherein the roll engagement can be controlled in a consistent and reproducible manner.

DESCRIPTION OF THE INVENTION

The invention will be best understood by reference to the accompanying figures wherein like parts are denoted by the same numerals.

Figure 1:
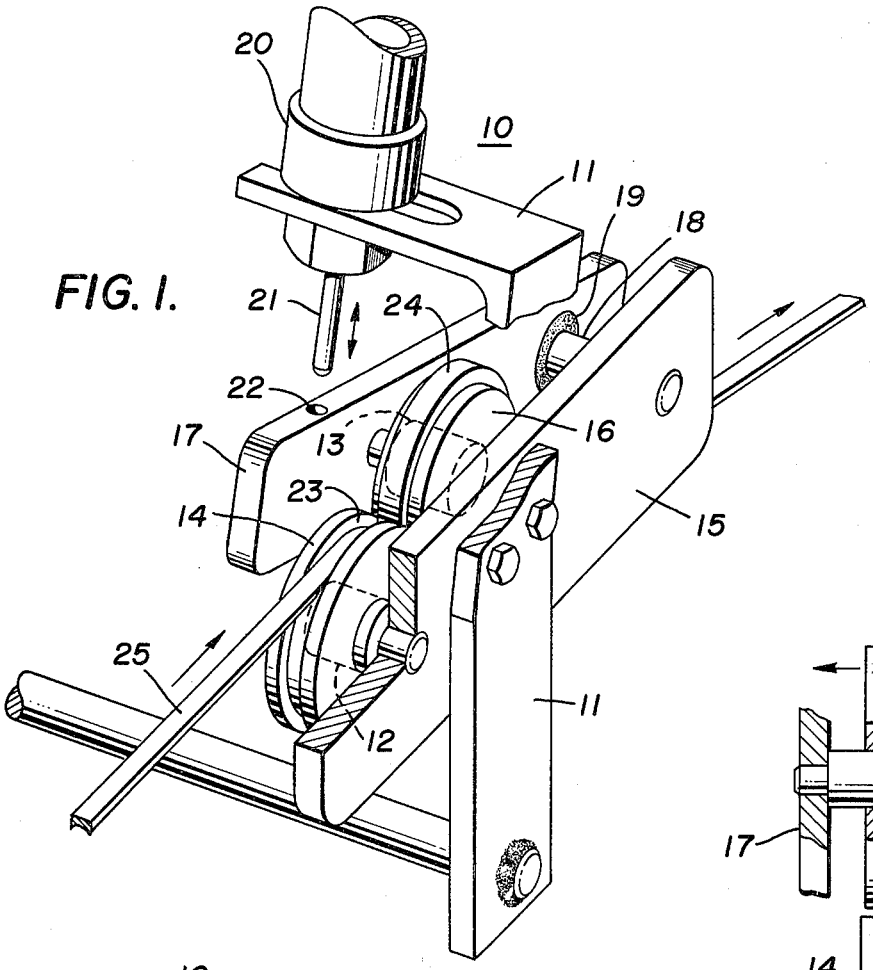
FIG. 1 is a perspective view of the apparatus of this invention.

Referring to FIG. 1, it is seen that the apparatus 10 is provided with a pair of rotatable rolls positioned between two spaced apart rectangular support members. The arbor 12 upon which roll 14 is positioned to permit rotation is mounted on support member 15 and arbor 13 upon which roll 16 is positioned is mounted on support member 17. Support members 15 and 17 are joined together by shaft 18. One end of shaft 18 is fixedly secured to support member 15 while the opposing end is positioned within a journaled bearing 19 provided in support member 17 for receiving the connecting shaft 18. This arrangement permits a pivotal movement of support member 17 on bearing 19 while support member 15 is maintained in a stationary position. Thus, since roll 16 is attached to support member 17, it is movable in correspondence with the pivotal movement of support member 17. This provides the capability for controlling the engagement of roll 16 with roll 14. Mounted on frame 11 is a pneumatically actuated piston assembly 20 which is adapted for applying a constant downward force on support member 17 which in turn is translated to roll 16. That is, the downward force is applied when piston 21 is actuated and brought into contact with support member 17 at notch 22. In this manner a constant roll engagement force is maintained while allowing engagement to vary. It will be apparent that means other than a pneumatically actuated piston could be used for this purpose. For example, a coiled pressure spring might be employed for applying a constant engagement force.

Figure 2:
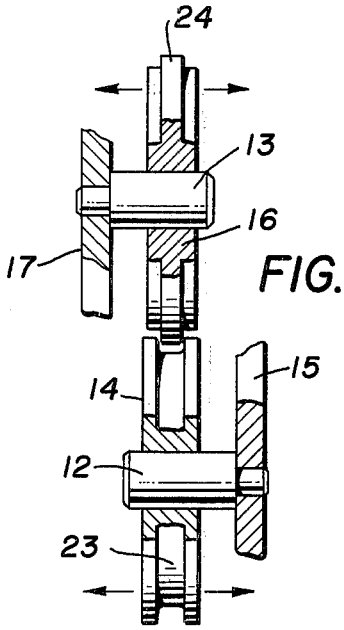
FIG. 2 is a top view in section of a pair of metal shaping rolls illustrating their arrangement in the apparatus of this invention.

Roll 14 is characterized by the presence of a continuous annular groove 23 having a curved bottom portion while roll 16 is provided with a continuous annular land 24 adapted to cooperate with groove 23. These mating structures are best seen by reference to FIGS. 2 and 3 of the drawings.

Figure 3:
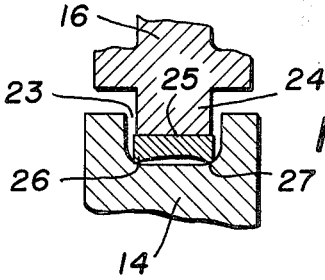
FIG. 3 is a front elevational view showing in enlarged detail a section of a pair of metal shaping rolls in engaging relationship.

In operation, a slit product 25 is guided into grooved roll 14 in a manner such that the burr formation is oriented into the bottom of groove 23. This is best shown in FIG. 3 where the burrs of slit product 25 are denoted by the numerals 26 and 27. The engagement of land 24 on roll 16 with the top surface of the slit product 25 causes the burrs to be forced against the curved bottom portion of groove 23 whereby shaping of the product is effected to eliminate the burr formation.

When shaping a slit product in this manner, deformation is concentrated in the region of the burr and little if any change results elsewhere in the cross-section.

The apparatus can accommodate a product thickness variation of ± 10 percent within permissible variations of roll engagement. Another advantage is that lace-up at the start of a run is greatly simplified because the shaping rolls 14 and 16 can be widely separated merely by reducing the engagement force to zero. Also, set-up is greatly simplified since engagement is set by setting a single pressure value on the engagement force air cylinder.

Figure 4:
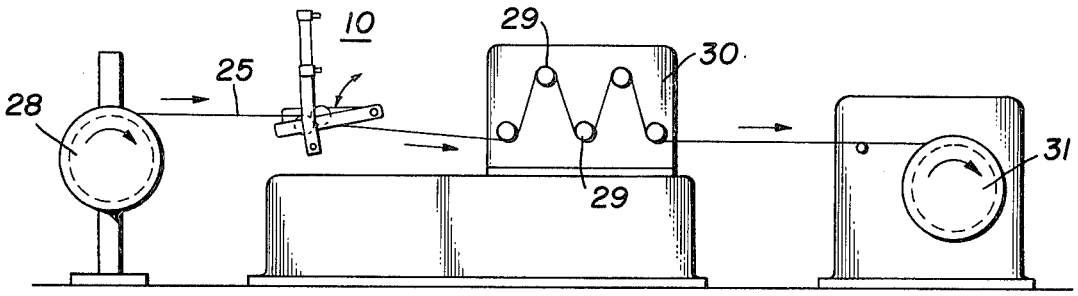
FIG. 4 is a schematic side elevational view of a pull roll stand in combination with the apparatus of this invention.

The apparatus may be employed in-line with the slitting operation or off-line in a manner such as is illustrated in FIG. 4 of the drawings.

As shown in FIG. 4, a slit product 25 is fed into shaping apparatus 10 from supply bobbin 28. The product is pulled through the shaping apparatus by a series of rotating pull rolls 29 mounted on pull roll stand 30. From the pull rolls the shaped, burr free product is forwarded to take-up bobbin 31. As will be apparent many other arrangements could be used for off-line operation since all that is required is a means for pulling the slit product through the shaping apparatus.

It has been found that best results are achieved when the slit product is introduced into the apparatus at an angle from about 7° to 30° with the tangent plane of the shaping rolls. When the entry angle is outside this range difficulty is often encountered in establishing and maintaining proper orientation of the product burr formation in the bottom portion of the grooved roll.

Although the present invention has been described and illustrated in connection with the preceding preferred embodiment, it is to be understood that modifications and variations may be resorted to without departing from the spirit of the invention, as those skilled in the art will readily understand. Such modificatons and variations are considered to be within the scope of the present invention as defined by the appended claims.

We claim:

1. In an apparatus for eliminating the burr on a slit metal wire or ribbon product by means of a pair of engaged rolls wherein a first roll has a continuous annular groove having a curved bottom portion and a second roll has a continuous annular land adapted to engage said groove so as to force the burr of said slit product into contact with the curved bottom portion of said groove, the improvement which comprises: a first stationary support member upon which said first roll is rotatably mounted and a second movable support member having said second roll rotatably mounted thereon, said support members being spaced apart a predetermined distance with said first and second rolls being positioned therebetween in an engaging relationship; means for permitting movement of said second support member, said means consisting of a shaft that connects said support members together and a journaled bearing member disposed in said second movable support member, wherein one end of said shaft is fixedly attached to said first stationary support member and the opposing end of said shaft is positioned within said journaled bearing member to permit pivotal movement of said second support member; and means for applying a constant downward force on said second movable support member to control the engagement of said second roll with said first roll.

2. The apparatus in accordance with claim 1, wherein the means for applying a constant downward force on said second movable support member consists of a pneumatically actuated piston.

3. The apparatus in accordance with claim 1, wherein said first and second support members are rectangular in shape.

4. The apparatus in accordance with claim 3, wherein said rectangular support members are positioned in a parallel arrangement.

* * * * *